United States Patent [19]

Stewart

[11] 4,307,826

[45] Dec. 29, 1981

[54] QUICK DISCONNECT HIP SUPPORTED BACKPACK

[76] Inventor: Marvin L. Stewart, 113 Elbring Dr., St. Louis, Mo. 63135

[21] Appl. No.: 60,580

[22] Filed: Jul. 25, 1979

[51] Int. Cl.[3] ..... A45F 3/10

[52] U.S. Cl. ..... 224/253; 224/211

[58] Field of Search ..... 224/153–156, 224/191, 196, 204–216, 250, 253, 258–264, 271

[56] References Cited

U.S. PATENT DOCUMENTS

| | | | |
|---|---|---|---|
| 204,066 | 5/1878 | Merriam | 224/213 X |
| 2,008,201 | 7/1935 | Chute | 224/262 |
| 2,133,717 | 10/1938 | Robes, Jr. | 224/156 X |
| 2,316,456 | 4/1943 | Robes, Jr. | 224/156 X |
| 2,864,361 | 12/1958 | Johnson | 224/211 |
| 3,184,128 | 5/1965 | Bucher | 224/214 |
| 3,831,827 | 8/1974 | Olson | 224/262 |
| 3,912,138 | 10/1975 | Pava | 224/214 |
| 3,921,867 | 11/1975 | Farnbach | 224/262 |
| 3,946,916 | 3/1976 | Lawrence | 224/262 |
| 3,989,173 | 11/1976 | Gebhard | 224/155 |
| 4,037,763 | 7/1977 | Turchen | 224/214 |

*Primary Examiner*—Stephen Marcus

*Attorney, Agent, or Firm*—Glenn K. Robbins

[57] ABSTRACT

A hip supported backpack having use for quick disconnection of the backpack to leave the user free thereof. The backpack is supported by a wide hip belt having two sockets at the rear which receive off-set short support shafts connected to the backpack frame. The load bearing portion of the backpack frame is borne in the sockets and the backpack is stabilized to prevent the pack from falling backwards by means of a breast strap fitting around the breast of the user. The backpack is dislodged by disconnecting the breast strap and then quickly moving the hip upwardly in a rolling action to propel the backpack upwardly out of the sockets to leave the user free of the backpack in an emergency situation or the like.

7 Claims, 7 Drawing Figures

QUICK DISCONNECT HIP SUPPORTED BACKPACK

SUMMARY OF THE INVENTION

In the past backpack frames have been used in a wide variety of environments. Thus, hikers, servicemen and a host of users of one type or another have used backpacks. Such backpacks are conventionally supported on the back by so-called backpack frames which are of various types of construction. They may be conventionally made using simple rigid frames having vertical stingers connected by cross braces to which the backpack load is connected.

It has been a problem in the past in various emergency situations to disconnect quickly the backpack frame from the body of the user. Thus, for example, servicemen in hostile and other emergency situations need to free themselves of the extra burden of the backpack load. Likewise, campers, hikers, outdoorsmen and others using backpacks have quite often a very difficult and serious need for quickly disconnecting the backpack load to completely free themselves and render themselves mobile to meet emergency situations and the like.

By means of this invention, there has been provided a simply supported backpack frame which is supported upon a hip belt. The use of a hip belt greatly simplifies the load carrying mechanism and evenly distributes the weight of the load upon the hips of the user which are best suited for bearing a load freely under conditions of stress and over long periods of time. The belt is of the type conventionally used by motorcyclists and the like constructed of heavy stiff leather or plastic and fairly wide to fit around the hips and buckled at the front. The belt is provided with a pair of sockets at the rear which are closed at the bottom and open at the top.

The backpack frame which may be of conventional construction otherwise, has a special lower support shaft connected at the bottom of the vertical stringer or frame members and off-set slightly therefrom. The support shafts are rigidly connected to the backpack and are fitted in the open sockets so that the load of the backpack frame is borne upon a hip belt.

To provide stability for the backpack frame and load and prevent it from being moved away from the body and falling backwards, a breast strap is connected to the backpack frame and is buckled around the breast of the user. A quick disconnect buckle is used so that the breast strap can be simply and rapidly disconnected.

When the emergency situation arises, requiring the backpack frame to be rapidly disconnected and removed, the user simply disconnects the breast strap and then simultaneously with a quick upward or bucking motion of the hips propels the weight of the backpack upwardly so that the support shafts are moved out of the sockets and the backpack and its load is thereby removed. The entire operation is accomplished in one or two seconds and renders the user free and mobile for meeting any emergency situation.

The support shaft may be simply connected to the backpack vertical frame members by a spacer which is nested between the support shaft and the frame member. The support shaft is clamped to the frame by a conventional constricting clamp or where desired, can be connected integrally in slightly off-set fashion from the frame members or as a part of the frame.

The hip support belt and the backpack support shaft are simple in construction and use and can be employed in a wide variety of usages by different types of outdoorsmen, servicemen and general members of the public as necessary. The hip support and frame are easy to use and evenly distribute the load to provide a stable and adaptable support system.

The above features are objects of this invention. Further objects will appear in the detailed description which follows and will be otherwise apparent to those skilled in the art.

For the purpose of illustration of this invention there is shown in the accompanying drawings a preferred embodiment thereof. It is to be understood that these drawings are for the purpose of example only and that the invention is not limited thereto.

IN THE DRAWINGS

DESCRIPTION OF THE INVENTION

Figure 1:
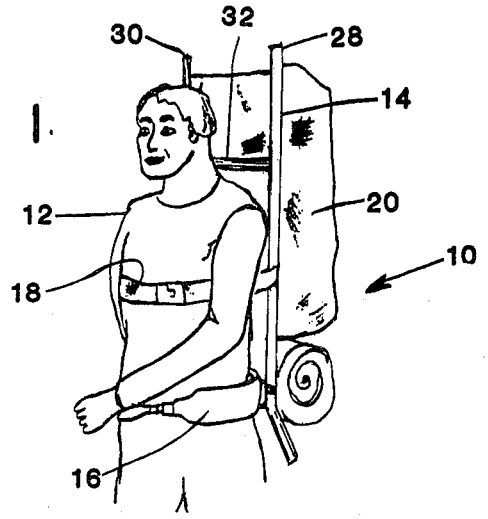
FIG. 1, is a pictorial view showing the backpack and hip support in use.

The hip supported backpack of this invention is generally identified by the reference numeral 10 in FIG. 1. It is shown in use by a man 12. The backpack is comprised of a conventional backpack frame 14 and a specially devised hip support belt 16 adapted to support the frame. A breast support strap of belt 18 is employed for horizontal stability to retain the backpack against the back of the user and preventing it from falling backwardly.

The special support means for supporting the backpack upon the hip belt for quick disconnect is encompassed in support shafts 22 which are adapted to be supported within sockets 24 and 26 attached to the hip belt. The support shafts 22 of which there are two in number are each connected to vertical frame members 28 and 30 of the backpack frame. These vertical frames are in turn connected to each other by conventional cross bracess 32.

Figure 2:
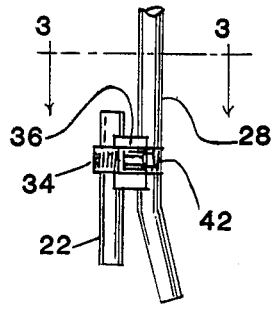
FIG. 2, is an enlarged view in side elevation showing the support shaft clamped to the back frame.
Figure 3:
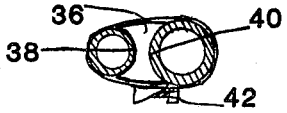
FIG. 3, is a further enlarged view in section taken on the line 3—3 of FIG. 2.

The support shaft 22 is best shown in FIGS. 2, and 3. As there shown, it is in the form of a short stub shaft connected by a clamp 34 to the backpack frame member 28. A spacer block 36 having concave portions 38 and 40 which receive in registering relationship the tubular shaft 22 and backpack frame member 28 is used to space the stub shaft from the backpack frame in order that the stub shaft or support shaft may be seated within the socket of the hip belt. The clamp 34 is used to tighten the support shaft to the vertical frame member 28 by a conventional tightening screw 42. In this manner, conventional backpack frames can be fitted with the support shaft by a simple connecting of the support shaft with the spacer block and the tightening clamp.

Figure 6:
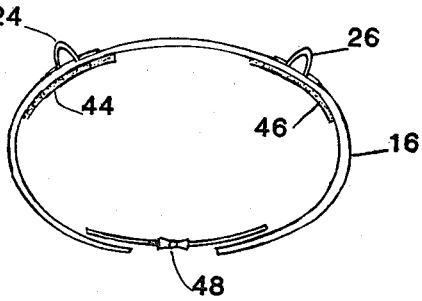
FIG. 6, is a top plan view of the hip support belt.
Figure 7:
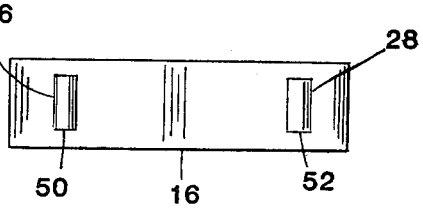
FIG. 7, is a view in rear elevation of the hip support belt.

The hip belt 16 is best shown in FIGS. 6 and 7. It is constructed of heavy leather or semi-rigid plastic to provide stiffness and rigidity and support on the hips. Padded portions 44 and 46 are used to cushion the hip belt upon the hips. A front buckle 48 of conventional structure is used to fasten the belt on the body of the user.

The sockets 24 and 26 are closed by a bottom wall 50 and 52 in order that the support shafts of the backpack frame can be fitted within the socket and bear against the bottom wall member and be thereby supported by the sockets upon the hip belt.

Figure 5:
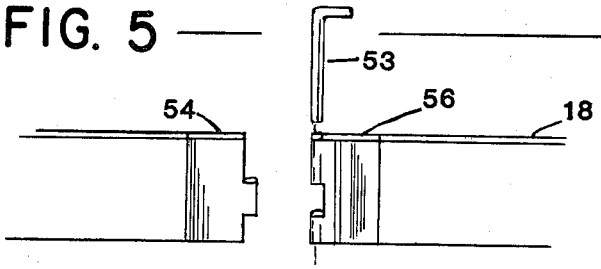
FIG. 5, is an exploded view in front elevation showing the quick disconnect breast strap.

The breast strap 18 and its connecting buckle are best shown in FIG. 5. The buckle is comprised of a quick disconnect pin 53 which fits within mating portions 54 and 56 of the buckle. This is a conventional form of buckle and, per se, forms no part of this invention except as a quick disconnect means for the breast strap when used in conjunction with the hip support and backpack frame of this invention.

Figure 4:
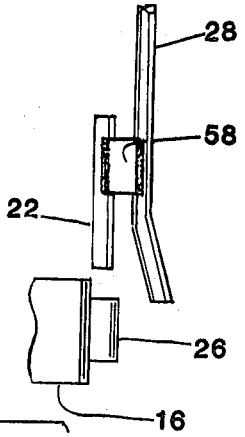
FIG. 4, is a view taken similarly to FIG. 2, but showing a modified intergral connection of the support shaft to the backpack frame.

A modified form of connection of the support shaft 22 to the backpack frame member 28 is shown in FIG. 4. In this modification a support block 58 is simply welded or otherwise affixed by conventional means to the support shaft 22 and the frame member 28. This form of connection can be done at the time of manufacture or otherwise.

USE

The user 12 desiring to employ the backpack of this invention can use the backpack in a conventional fashion. Thus the backpack is simply loaded with the load 20 in the normal operation. The hip belt is placed upon the hip of the user and buckled together by means of buckle 48. The backpack frame is simply lifted by the user with the bottom of the support shafts 22 being placed in the sockets. The user buckles the breast strap 18 around his breast by the connection of the quick disconnect pin 53 which fits through the two portions of the buckles 54 and 56. The backpack with the load is firmly supported upon the hip by the interfitting of the support shaft 22 within the hip belt sockets 50 and 52. The full load is easily distributed upon the hips and is efficiently borne by the user. The breast strap is employed for stability to prevent the backpack from falling backwards and is not otherwise of a load bearing nature.

When the user in emergency situations of one type or another needs to have the backpack quickly removed, the user simply pulls out the connecting pin 53 of the buckle of the breast strap and then with a quick upward motion of the hips propels the backpack and support shafts out of the sockets. The backpack and frame then simply falls out and is dislodged from this "bucking" action. The removal, after the breast strap has been disconnected is extremely simple and can be accomplished in a matter of second or two by the afore-mentioned bucking or rapid upward movement of the hips to propel the backpack out of the hip belt support.

By the support means for the backpack frame and the hip belt of this invention there has been provided a very simple means for supporting the backpack frame upon the hip in an even load bearing fashion where the backpack can be worn for a long period of time or under periods of strain. Further and quite importantly in an emergency situation the backpack can be very simply dislodged or removed to render the user completely mobile and free of the harnessing and impeding action of the backpack and its load.

Various changes and modifications may be made within this invention as will be readily apparent to those skilled in the art. Such changes and modifications are within the scope and teaching of this invention as defined by the claims appended hereto.

What is claimed is:

1. A hip supported backpack adapted to be rapidly disconnected comprising a backpack frame, a hip belt having a pair of open topped socket members positioned at a back portion of said belt, support shafts supporting said frame in load bearing relation connected to said frame slidably removable and receivable within said sockets and breast strap means connected to said frame and removably fittable around the breast of a user, said breast straps means extending beneath the user's arms in a non-load bearing arrangement.

2. The backpack of claim 1, in which said breast strap means is provided with a quick disconnect buckle means.

3. The backpack of claim 2, in which said shafts comprise a pair of shoft shafts connected in off-set relation to vertical backpack frame members, said shafts having a free end slidably receivable within said sockets and a spacer member having a pair of opposed concave faces is interfitted in mating relation with said support shaft and said vertical frame member.

4. The backpack of claim 1, in which said support shafts comprise a pair of short shafts connected in off-set relation to vertical backpack frame members, said shafts having a free end slidably receivable within said sockets.

5. A hip supported backpack adapted to be rapidly disconnected comprising a backpack frame, a hip belt having a pair of open topped socket members, support shafts connected to said frame receivable within said sockets and breast strap means connected to said frame and removably fittable around the breast of a user, said support shafts comprising a pair of short shafts connected in offset relation to vertical backpack frame members, said shafts having a free and slidably receivable within said sockets and a spacer member having a pair of opposed concave faces interfitted in mating relation with said support shaft and said vertical frame member.

6. The backpack of claim 5, in which said support shaft is connected to said vertical frame member by removable clamp means.

7. The backpack of claim 5, in which said spacer is integrally connected to said support shaft and said vertical frame member.

* * * * *